United States Patent [19]

Hani et al.

[11] Patent Number: 4,885,058

[45] Date of Patent: Dec. 5, 1989

[54] INORGANIC PAPER AND METHOD FOR ITS MANUFACTURE

[75] Inventors: Kiyoshi Hani, Sagamihara; Takako Takei, Tokyo; Minekazu Kodama, Takatsuki; Takahiko Watanabe, Machida, all of Japan

[73] Assignee: Mitsubishi Denki Kabushiki Kaisha, Tokyo, Japan

[21] Appl. No.: 646,094

[22] Filed: Aug. 31, 1984

[30] Foreign Application Priority Data

Oct. 4, 1983 [JP] Japan ..... 58-185337

[51] Int. Cl.[4] ..... D21H 5/18; 162 145; 162 152; 162 146

[52] U.S. Cl. ..... 162/145; 162/146

[58] Field of Search ..... 162/145, 152, 146

[56] References Cited

U.S. PATENT DOCUMENTS

| | | | |
|---|---|---|---|
| 2,999,788 | 9/1961 | Morgan | 162/146 |
| 3,573,158 | 3/1971 | Pall et al. | 162/145 |
| 4,234,379 | 11/1980 | Conway et al. | 162/152 |
| 4,341,597 | 7/1982 | Andersson et al. | 162/145 |
| 4,421,599 | 12/1983 | Kuzuoka et al. | 162/145 |
| 4,498,957 | 2/1985 | Sasaki et al. | 162/146 |

OTHER PUBLICATIONS

Kogyo Zairyo, vol. 30, No. 8, p. 105–108 (1982).

*Primary Examiner*—Peter Chin

*Attorney, Agent, or Firm*—Oblon, Spivak, McClelland, Maier & Neustadt

[57] ABSTRACT

Inorganic paper, which is made through paper-making process from a mixture consisting essentially of:

(a) fibrous inorganic compound, as the principal component, having a fiber diameter of 100 microns or smaller and a fiber length which is ten times or more as long as the fiber diameter; and (b) fiber material in a microfibrillar form as a binding agent.

20 Claims, No Drawings

INORGANIC PAPER AND METHOD FOR ITS MANUFACTURE

BACKGROUND OF THE INVENTION

1. Field of the Invention

This invention relates to inorganic paper and a method for its production. More particularly, it is concerned with inorganic paper which is effective as a reinforcing material for composite type plastic sheet, and a method for producing the same.

2. Description of the Prior Art

As the reinforcing materials for the composite type plastics which are in general use, there have so far been known granular inorganic compounds, i.e., fillers, papery base materials with various sorts of pulp being used as the raw material, and, as materials having much higher reinforcing property, various inorganic fibrous compounds represented by glass fibers. These reinforcing materials are used by appropriate selection depending on required performance of the composite type plastics or their manufacturing costs.

The shapes of the composite plastics containing those inorganic compounds as mentioned above take various forms such as, for example, powders, pellets, sheets, and others. However, in the case of manufacturing laminated shaped article, the shape required is the sheet form. The advantageous feature of the sheet-like shape is such that it can be readily shaped into any configurations as those shaped articles in thick gauge, thin guage, or large size, and those shaped articles in complicated configurations.

As the inorganic reinforcing material in the sheet form, there has so far been known the so-called "unwoven cloth" produced by uniformly dispersing fibrils cut into a length of from a few millimeters to a few centimeters from glass fiber, carbon fiber, etc., or woven cloth of such glass fiber and carbon fiber, and then gluing together the uniformly dispersed fibrils with an adhesive agent. This unwoven cloth is an effective reinforcing material for the composite type plastic. Such reinforcing material is usually required to have resistance against impregnation treatment, because it is subjected, in most cases, to impregnation with liquefied resins or resin liquids using solvents. It is also necessitated to have sufficient binding force to prevent itself from unravelling, when impregnated with the liquefied resin or the resin liquid. Accordingly, the solvent-resistant property, the water-resistant property, and the chemicals-resistant property of the binding agent also constitute important characteristics.

However, such reinforcing material is required to have a continued fiber length or a fiber length of a few millimeters or longer. It is therefore difficult to make those inorganic compounds having very short fiber length such as, for example, whisker or fibrous particles into the woven cloth or the unwoven cloth as mentioned in the foregoing.

When the microfibers such as whisker and fibrous particles are made into continuous sheet such as woven cloth, unwoven cloth, paper, and so forth, a large quantity of binding agent becomes necessary, because no reinforcing effect can be expected from entanglement among the component fibers. Even if such microfiber material is made into a sheet form by use of a large amount of binding agent, the sheet product is disadvantageously brittle and poor in its mechanical strength.

SUMMARY OF THE INVENTION

The present invention has been made with a view to removing these various disadvantages inherent in the conventional plastic sheet as described in the foregoing, and aims at providing inorganic based paper effective as the reinforcing material for such plastic sheet, which has a higher content of inorganic compound and a paper strength of practically usable paper. The present invention is also directed to provide a method for producing such inorganic paper For brevity such paper is hereinafter termed inorganic paper.

According to the present invention, in one aspect of it, there is provided inorganic paper which is made through paper-making process from a mixture consisting essentially of: fibrous inorganic compound i.e. an inorganic fiber, as the principal component, having a fiber diameter of 100 microns or smaller and a fiber length which is ten times or more as long as the fiber diameter; and as a minor component organic fiber material in microfibrillar form as a binding agent.

According to the present invention, in another aspect of it, there is provided a method for producing inorganic paper, which comprises steps of: uniformly dispersing in a dispersion medium selected from the group consisting of water and organic solvents a fibrous inorganic compound, as a principal component, having a fiber diameter of 100 microns or smaller and a fiber length which is ten times or more as long as the fiber diameter, and fiber material in a microfibrillar form as a binding agent, both materials being in their predetermined quantities; subjecting the dispersion liquid to paper-making process by means of a paper-making machine using a metal net of a mesh size which does not permit said fibrous inorganic compound to pass through it; peeling the mixture of said fibrous inorganic compound and said binding agent remaining on said metal net; and subjecting said peel-off to a heat-fusing process under a pressure and at a temperature in the vicinity of a melting point of said binding agent; and drying the press-formed article.

The foregoing object, still other objects, advantages and features of the present invention will become more readily apparent and understandable from consideration of the following detailed description thereof, in reference to several preferred examples thereof.

DETAILED DESCRIPTION OF THE INVENTION

As the fibrous inorganic compound according to one embodiment of the present invention, there may be used in appropriate selection those whiskers selected from magnesia, alumina, beryllium oxide, boron carbide, silicon nitride, silicon carbide, potassium titanate, and graphite, or fibrous particles obtained by cutting long continuous fibers into a length of a few millimeters or shorter. Also, powdery materials such as glass, asbestos, zirconia fiber, etc. which are comminuted to a particulate size may be used.

The diameter of the inorganic fibrous compound is 100 microns or smaller, and the length thereof is ten times or more as long as the fiber diameter. When the fiber diameter exceeds 100 microns, the inorganic paper lacks in its pliability, and, when the fiber length is not more than ten times as long as the fiber diameter, no paper-making can be effected. Further, when the fiber length becomes 50 mm or longer, uniform dispersion of the fibrous inorganic compound becomes difficult in preparing the paper-making solution.

The fiber material in microfibillar form for use as the binding agent in the present invention may be in single fiber form obtained by opening to a fiber diameter of a few microns or smaller after removal impurities from cotton, linen, wool, silk, or various natural fibers and regenerated fibers in microfibrillar form such as cellulose from timber as the raw material, and cellulosic derivatives such as viscose rayon, acetate fiber, etc. In particular, use of various celluloses is preferred in obtaining the inorganic paper of sufficient paper strength with small added quantity thereof. Further, same as the cellulose fiber, there may be used various kinds of synthetic fibers in microfibrillar form, the single fiber diameter of which has been reduced to an order of a few microns. For example, use may be made of polyamide type fibers, polyvinyl alcohol type fibers, polyvinylidene chloride type fibers, polyvinyl chloride type fibers, polyacrylonitrile type fibers, polyester type fibers, polyethylene type fibers, polypropylene type fibers, polyurethane type fibers, polycyanated vinylidene type fibers, polyfluoroethylene type fibers, and so forth,, all of which have been unravelled to a single fiber by application of a strong shearing force after the fibers have been stretched to their limit or in the vicinity thereof. Besides these, there may also be used heat-resistant organic fibers such as total aromatic polyamide fibers, phenol formaldehyde fibers, and so forth, which have been rendered to be microfibrillar. Furthermore, not limiting to those fibers as mentioned in the preceding, those substances, the single fiber of which has been made microfibril of a fiber diameter of a few microns or smaller may also be used as the binding agent, provided that they exhibit the same effect as that of the above-enumerated fibers at the time of the paper-making process.

As mentioned in the foregoing, it is preferable to use the fiber materials, as the binding agent, by making them microfibrils of a fiber diameter of an order of a few microns or smaller. In case of using fiber material, the single fiber diameter of which is a few microns or larger, the strength of the resulted inorganic paper becomes lowered. In order to increase its strength, a large amount of the binding agent is required to be added, which is not recommendable. From this, it is preferable to use those fibers, as the binding agent, having a fiber diameter which is extremely thinner than the fiber diameter of the fibrous inorganic compound to be used, i.e., those fibers with the fiber diameter thereof having been adjusted to less than one tenth of the fiber diameter of the fibrous inorganic compound. Also, the fiber length of the fiber material for use as the binding agent should preferably be longer than that of the fibrous inorganic compound, though no particular restriction is imposed on it.

By the way, a blending ratio of the binding agent should most preferably in a range of from 0.5 to 10% by weight with respect to the fibrous inorganic compound. When the binding agent is less than 0.5% by weight, the inorganic paper attains very low strength, hence it is not practicable. On the contrary, when more than 10% by weight of the binding agent is added, the characteristics of the fibrous inorganic compound is sacrificed.

The inorganic paper according to the present invention is of such a construction as mentioned above, and is obtainable by, for example, a method for its production to be mentioned in the following. That is to say, the above-mentioned fibrous inorganic compound and the above-mentioned binding agent in their predetermined quantities are uniformly dispersed in a dispersion medium such as water, organic solvents, and others so as to get the binding agent entangled uniformly on the surface of the fibrous inorganic compound, after which the dispersion is subjected to the paper-making process by means of an ordinary paper-making apparatus using a metal net of a mesh size which does not permit the fibrous inorganic compound to pass through it. After this, the mixture of the fiber material and the binding agent remaining on the metal net is peeled off, and subjected to heat-fusing process under a pressure and at a temperature in the vicinity of a melting point of the binding agent, followed by drying the same. In this manner, there can be obtained the inorganic paper according to one example of the present invention.

Incidentally, as it is necessary that the binding agent be uniformly dispersed in the dispersion medium such as water, organic solvent, etc., and be evenly adhered onto the surface of the fibrous inorganic compound, mixing of the fibrous inorganic compound and the binding agent should be done in a large amount of dispersion medium with vigorous agitation. For the agitating device, the most preferred is the use of a high speed agitator or a homogenizer, wherein shearing force is applied to the mixture during the agitation. Moreover, at the time of agitation with use of the above-mentioned agitating device, there may be added, other than the binding agent, those additives of ordinary use at the time of the paper-making process such as, for example, paper strength intensifying agent, water resisting agent, viscosity adjusting agent, defoaming agent, and others.

With a view to enabling those persons skilled in the art to reduce the present invention into practice, concrete explanations will be given in the following in reference to preferred examples thereof. It should however be understood that these examples are illustrative only and not so restrictive, and that any changes and modifications may be made in the ingredients used and various parameters within the spirit and scope of the invention as recited in the appended claims.

EXAMPLE 1

Into a vessel of 30 liter-capacity, 200 g of accurately weighed alumina fibril ("SUFFIL" ®, a product of ICI) having a fiber diameter of 3 microns and a fiber length of from 50 to 100 microns was placed. Following this, 1,110 g of cellulose fiber in the micrifibrillar form ("MFC" ® in aqueous solution containing therein 2% of the fiber, a product of Dicel Chemical Industries Ltd., Japan) as the binding agent was added to the alumina fibril. (Of 1,110 g of the cellulose fiber, the content of the fiber was 2%, i.e., 22.2 g.) Thereafter, 20 liters of water was further added to the vessel. The thus prepared mixture liquid was agitated for approximately five minutes by means of a high speed agitating device. After the agitation, a small quantity of the dispersion liquid was taken in a graduated measuring cylinder of a 500 cc-capacity, followed by addition of a large quantity of water to it and sufficient mixing of the liquids, thereby ascertaining through the eyes whether the alumina fibril had been uniformly dispersed, or not. In this instance, if it is found that the alumina fibril and the cellulose fiber are floating on the dispersion medium without being disaggregated, the high speed agitation is conducted for another five-minute. After verifying the uniform dispersion of the fiber, 250 cc of the dispersed liquid was subjected to the paper-making process using a square sheet machine (manufactured by Kumagai Riki Kogyo K.K., Japan). Subsequent to the paper-making process, the paper was dried by a rotary drier (at 160° C.), whereby alumina paper of a 250×250 mm square and a thickness of approximately 0.15 mm was obtained. The properties of the thus obtained alumina paper are shown in Table 1 below.

EXAMPLES 2 to 3

In the same manner as in Example 1 above, 2 sorts of alumina paper with different alumina contents were obtained. The composition and properties of the thus obtained alumina paper are shown in Table 1 below.

TABLE 1

| Example | Composition of inorganic paper | | | Properties of inorganic paper | | |
|---|---|---|---|---|---|---|
| | SUFFIL ® (g) | MFC ® (g) | Water (l) | Alumina content (%) | Weight (g/m²) | Tensile strength (kg/cm²) |
| 1 | 200 | 1110 | 20 | 89.5 | 62.1 | 42.3 |
| 2 | 200 | 555 | 20 | 94.3 | 62.3 | 28.5 |
| 3 | 200 | 333 | 20 | 96.7 | 63.1 | 26.2 |

EXAMPLES 4 to 6

Using an SiC whisker ("TOKAMAX" ®, a product of Tokai Carbon Co., Ltd., Japan) having its fiber diameter of from 0.1 to 100 microns and its fiber length of from 10 to 1000 microns, SiC paper was manufactured in the same manner as in Example 1 above. The composition and properties of the SiC paper thus obtained are shown in Table 2 below.

TABLE 2

| Example | Composition of inorganic paper | | | Properties of inorganic paper (1) | | |
|---|---|---|---|---|---|---|
| | TOKAMAX ® (g) | MFC ® (g) | Water (l) | Sic content (%) | Weight (g/m²) | Tensile strength (kg/cm²) |
| 4 | 50 | 275 | 5 | 91.3 | 50.7 | 31.3 |
| 5 | 50 | 193 | 5 | 93.1 | 51.3 | 27.5 |
| 6 | 50 | 138 | 5 | 95.3 | 52.7 | 23.2 |

Note: (1) paper thickness: from 0.15 mm to 0.17 mm

EXAMPLE 7

200 g of alumina fibril ("SUFFIL" ®, a product of ICI) was placed in a vessel of a 30-liter capacity, and then 10.5 g of keblar fiber ("KEBLAR 49" ®, a product of E. I. du Pont de Nemours & Co., U.S.A.), which was pre-treated by the undermentioned process, was added to the content in the vessel, as the binding agent.

The pre-treatment of the keblar fiber was done in the following manner. That is to say, a long continuous fiber of 11.9 microns in filament diameter was cut in a length of 10 mm, and then the fiber as severed was treated for ten minutes in a large quantity of water by means of a homogenizer (manufactured by Nippon Seiki K.K., Japan), whereby the fiber became much thinner and the filament diameter was also reduced much more. The finely dispersed fiber in the water was recovered through a filter, and dried for use as the binding agent.

In the next place, 20 liters of water was added to the vessel, and the fiber was uniformly dispersed by means of a high speed agitating device. After verifying the dispersed state of the fiber, the dispersion liquid was subjected to the paper-making process by use of a square sheet machine. After drying the thus produced paper, it was passed through a pair of rollers heated to a temperature of 250° C., thereby obtaining alumina paper having thickness of 0.2 mm. The thus obtained alumina paper had a tensile strength of 37 kg/cm², which was the strength sufficiently durable against the impregnation treatment, even when epoxy resin was impregnated in it.

EXAMPLES 8 to 10

By use of fibrous powder of boron nitride (BN) ("CBN" ® VHP-FM, a product of Showa Denko K.K., Japan), BN paper was manufactured in the same manner as in Example 1 above. Table 3 below shows the composition and the properties of the BN paper.

TABLE 3

| Example | Composition of inorganic paper | | | Properties of inorganic paper (1) | | |
|---|---|---|---|---|---|---|
| | CBN ® (g) | MFC ® (g) | Water (l) | BN content (%) | Weight (g/m²) | Tensile (kg/cm²) |
| 8 | 50 | 275 | 5 | 89.3 | 56.8 | 19.6 |
| 9 | 50 | 220 | 5 | 91.3 | 57.1 | 18.3 |
| 10 | 50 | 165 | 5 | 93.6 | 58.7 | 15.4 |

Note: (1) paper thickness: from 0.15 mm to 0.17 mm

EXAMPLES 11 to 15

Potassium titanate paper was manufactured in the same manner as in Example 1 above using potassium titanate whisker ("TISMO" ®, a product of Otsuka Kagaku Yakuhin K.K., Japan), as the principal component for the inorganic paper, a binding agent ("MFC" ®, a product of Dicel Kagaku K.K., Japan), and polyvinyl alcohol fibril ("S.M.H." ®, a product of Unitica Co. Ltd., Japan). The composition of the paper-making solution and the properties of the paper thus obtained are shown in Table 4 below.

TABLE 4

| Example | Composition of inorganic paper | | | | Properties of inorganic paper (1) | | |
|---|---|---|---|---|---|---|---|
| | TISMO ® (g) | MFC ® (g) | SMH ® (g) | Water (l) | Content of potassium titanate (%) | Weight (g/m²) | Tensile strength (kg/cm²) |
| 11 | 100 | 278 | 5.55 | 10 | 90.2 | 65.5 | 27.3 |
| 12 | 100 | 270 | 2.70 | 10 | 91.8 | 66.3 | 26.5 |
| 13 | 100 | 217 | 4.34 | 20 | 91.0 | 66.8 | 25.7 |
| 14 | 100 | 213 | 2.12 | 10 | 95.6 | 67.3 | 19.8 |

TABLE 4-continued

| Example | Composition of inorganic paper | | | | Properties of inorganic paper (1) | | |
|---|---|---|---|---|---|---|---|
| | TISMO ® (g) | MFC ® (g) | SMH ® (g) | Water (l) | Content of potassium titanate (%) | Weight ($g/m^2$) | Tensile strength ($kg/cm^2$) |
| 15 | 100 | 156 | 1.04 | 10 | 96.1 | 67.9 | 14.3 |

Note:
(1) paper thickness: from 0.15 mm to 0.17 mm

As described in the foregoing, the present invention is capable of providing an inorganic paper having high content of inorganic compound and sufficient paper strength to be practically useful, the inorganic paper being made from a mixture consisting of fibrous inorganic compound, as the principal component, having a fiber diameter of 100 microns or smaller and a fiber length which is ten times or more as long as the fiber diameter; and fiber material in a microfibrillar form as a binding agent, through a paper-making process. This inorganic paper can be manufactured through the continuous paper-making process, and is highly effective as the reinforcing material for plastic, in substitution for glass cloth and glass mat.

What is claimed is:

1. Inorganic based paper, which is made through paper-making process from a mixture consisting essentially of:

(a) as the principal component inorganic fibers composed of an inorganic material and having a fiber diameter of 100 microns or smaller and a fiber length which is ten or more times the fiber diameter; and as the minor component (b) organic fiber material in a microfibrillar form as a binding agent.

2. The inorganic based paper according to claim 1, wherein said inorganic fibers are whiskers of at least one material selected from the group consisting of magnesia, alumina, beryllium, oxide, boron nitride, silicon carbide, silicon nitride, potassium titanate, and graphite.

3. The inorganic based paper according to claim 1, wherein said inorganic fibers are fibrous particles obtained by cutting long continuous fibers into lengths of a few millimeter or less.

4. The inorganic based paper according to claim 1, wherein said inorganic fibers are composed of a comminuted powdery material selected from the group consisting of glass, asbestos, and zirconia fiber.

5. The inorganic based paper according to claim 1, wherein said component (b) is in the range of from 0.5% by weight to 10% by weight with respect to the principal component (a).

6. The inorganic based paper according to claim 1, wherein said organic fiber material component (b) in microfibrillar form is selected from the group consisting cellulose, cellulosic derivatives and synthetic materials.

7. The inorganic based paper according to claim 1, wherein said microfibrillar form is a single fiber obtained by opening cotton, line, wool or silk from which impurities have been removed.

8. The inorganic based paper according to claim 6, wherein said cellulosic derivative is selected from the group consisting of viscose rayon and acetate.

9. The inorganic based paper according to claim 6, wherein said microfibrillar cellulose is a natural fiber component.

10. The inorganic based paper according to claim 8, wherein said cellulosic derivative is regenerated cellulose.

11. The inorganic based paper according to claim 6, wherein said synthetic material in microfibrillar form is selected from the group consisting of polyamide type fibers, polyvinyl alcohol type fibers, polyvinylidene chloride type fibers, polyvinyl chloride type fibers, polyacrylonitrile type fibers, polyester type fibers, polyethylene type fibers, polypropylene type fibers, polyurethane type fibers, polycyanated vinylidene type fibers, and polyfluoroethylene type fibers.

12. The inorganic based paper according to claim 11, wherein said synthetic fiber material in microfibrillar form is one which has been reduced to a single fiber by strong shearing force, after it has been stretched to its limit or in the vicinity thereof.

13. The inorganic based paper according to claim 6, wherein said synthetic material in micrifibrillar form is heat resistant organic fiber selected from the group consisting of total aromatic polyamide fibers and phenol formaldehyde fibers.

14. The inorganic based paper according to claim 1, wherein the fiber diameter of the fiber material (b) constituting said binding agent is one tenth or less than the fiber diameter of said fibrous inorganic fibers.

15. The inorganic based paper according to claim 1, wherein the fiber length of the fiber material constituting said binding agent is longer than the fiber length of said inorganic fibers.

16. A method for producing inorganic paper, which comprises steps of:

(a) uniformly dispersing in a dispersion medium selected from the group consisting of water and organic solvents inorganic fibers, as a principal component, having a fiber diameter of 100 microns or smaller and a fiber length which is ten or more times the fiber diameter, and fiber material in a microfibrillar form as a binding agent;

(b) permitting said binding agent to be uniformly adhered on the surface of said inorganic fibers, and thereafter subjecting the dispersion liquid to a paper-making process by means of a paper-making apparatus using a metal net of a mesh size which does not permit said fibrous inorganic compound to pass through it;

(c) peeling the mixture of said fibrous inorganic compound and said binding agent remaining on said metal net;

(d) subjecting said peel-off to a heat-fusing process under a pressure and at a temperature in the vicinity of the melting point of said binding agent; and (e) drying the press-formed article.

17. The method for producing inorganic based paper according to claim 16, wherein at least one of the conventional paper making additives is added at the time of uniformly dispersing said inorganic fibers and fiber material in the microfibrillar form in said dispersion medium.

18. The method for producing inorganic paper according to claim 17, wherein said additives are paper strength intensifying agent, water resisting agent, viscosity adjusting agent, and defoaming agent.

19. The inorganic based paper of claim 1, wherein the component (b) in microfibrillar form is in single fiber form and of a fiber diameter of the order of a few microns or smaller which is one tenth or less of the fiber diameter of the fibers of component (a).

20. The inorganic based paper according to claim 19, wherein the binding component (b) is 0.5 to 10% by weight of component (a), wherein the diameters of the component (b) fibers are one tenth or less than the diameters of the component (a) fibers, and wherein the component (a) fibers are not greater than 50 mm in length.

* * * * *